United States Patent [19]

Wahl

[11] Patent Number: 4,854,904

[45] Date of Patent: Aug. 8, 1989

[54] SAILBOARD WITH ADJUSTABLE KEEL MECHANISM

[76] Inventor: Eric R. Wahl, 613 Carmel Ave., Albany, Calif. 94706

[21] Appl. No.: 213,268

[22] Filed: Jun. 29, 1988

[51] Int. Cl.[4] ..... A63C 15/06

[52] U.S. Cl. ..... 441/79; 114/133; 114/140

[58] Field of Search ..... 114/79.1, 39.2, 127, 114/128, 133, 134, 140, 143; 441/79

[56] References Cited

U.S. PATENT DOCUMENTS

| | | | |
|---|---|---|---|
| 4,377,124 | 3/1983 | Guigan | 114/128 |
| 4,493,665 | 1/1985 | Liddle | 114/127 |
| 4,660,489 | 4/1987 | Attey | 114/39.2 |
| 4,733,496 | 3/1988 | Wallner | 441/79 |

FOREIGN PATENT DOCUMENTS

| | | | |
|---|---|---|---|
| 3123967 | 1/1983 | Fed. Rep. of Germany | 114/39.2 |
| 20591 | 2/1983 | Japan | 114/127 |
| 8303375 | 4/1985 | Netherlands | 114/127 |

*Primary Examiner*—Sherman D. Basinger
*Assistant Examiner*—Stephen P. Avila
*Attorney, Agent, or Firm*—Shlesinger, Fitzsimmons & Shlesinger

[57] ABSTRACT

A planing-type hull has a keel which projects downwardly from a disk which is mounted in the bottom of the hull for limited rotational movement about a vertical axis located rearwardly of the center of the keel. In a second embodiment the keel projects downwardly from a sector or generally pie-shaped member, which is pivotal in the bottom of the hull between two limit positions. A spring-loaded detent may be employed to return the keel to a centered position.

16 Claims, 3 Drawing Sheets

FIG. 3
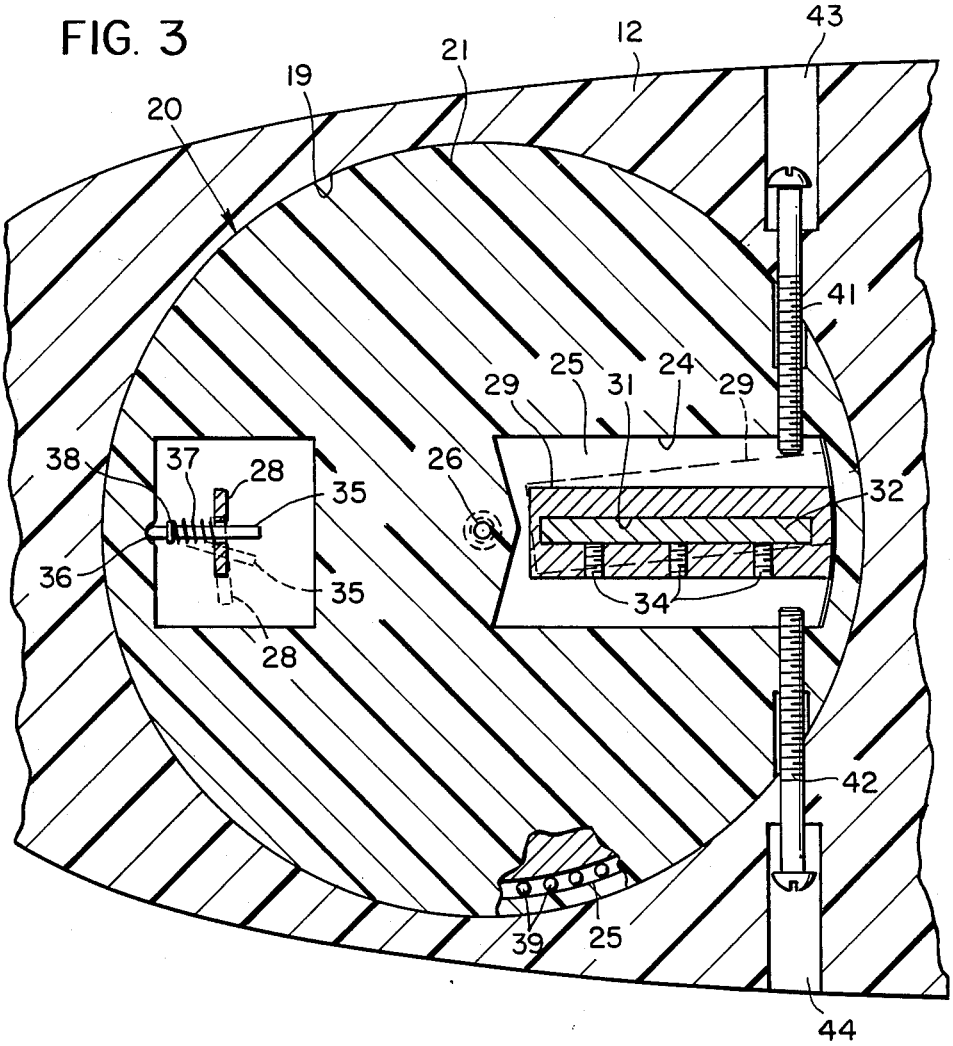
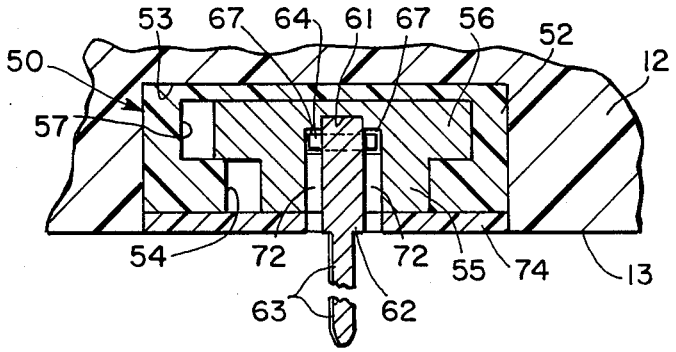
FIG. 6

SAILBOARD WITH ADJUSTABLE KEEL MECHANISM

BACKGROUND OF THE INVENTION

This invention relates in general to small sailing craft, and more particularly to sailboards of the type employed by windsurfers. Even more particularly this invention relates to a planing type of sailboard having an adjustable keel mechanism for directing the sailboard along a path extending substantially in the direction of the longitudinal axis of the sailboard.

Sailboards are currently the fastest and most maneuverable type of sailing boat. The fastest designs have the usual, generally flat, planing-type hull, and a single, fixed keel, which normally is disposed in a vertical plane through the longitudinal centerline of the hull to provide the necessary lift to windward for sailing. As a general rule there are no pivotal rudders or other hydrofoils on the hull.

However, despite great experimentation with hull and keel shapes, a plateau has been reached in the achievement of top speeds. The current record speed is approximately 38 knots. Many hull designs achieve speeds close to that limit but have not been able to exceed it. The plateau is not due to sail inefficiency alone, since ice and land sailing vessels of similar configuration and sail design are capable of much higher speeds than sailboards or a sailboats in general.

At present the greatest limitation on high-speed sailboard performance arises from the necessity of holding the keel, and consequently the hull, at an angle to the oncoming water-flow in order to generate lift. Just as in the case of an airfoil, a hydrofoil produces lift only when it has an angle of attack to the ambient flow. Thus, for a conventional sailboard to accelerate or maintain speed on any point of sail, except dead downwind, the hull and its fixed keel must move obliquely, or "make leeway".

The oblique movement of the hull leads to problems at high speed. First, the hull cannot be shaped to plane with the least possible drag, since it must be a compromise between two angles of operation, normally differing by approximately ten degrees. For example, when a concave channel on the hull bottom is oriented to increase planing efficiency on one tack, it will be incorrectly oriented on the other tack. As a consequence, conventional sailboards are not as fast as they could be if the hull were to be caused to move or sail exactly in the direction of its longitudinal axis, when planing. Secondly, at high speeds rough water generally makes control of a conventional sailboard difficult. The reason for this is the need to keep a relatively large hull at a constant, oblique orientation to the oncoming water, even as the degree of submersion varies from substantial to none. Obviously it would be easier to control a hull that tracks straight through rough water, for example at right angles to the oncoming water.

Prior to this invention, sailboards could not be sailed in such manner that their hulls would sail or move in a direction substantially coincident with the longitudinal axis of the hull on both tacks, or in other words without crabbing, or moving obliquely. U.S. Pat. No. 4,478,164, for example, sought to improve the performance of a sailboard by using an improved universal joint for supporting two pivotal masts, and by adding to the stern of the board a pivotal rudder connected by a steering mechanism to one of the sails. This sailboard, however, like most conventional sailboards, also utilizes a stationary (during use) centerboard or keel, which functions in the usual manner to minimize leeward drift, and to enable the bow to be held at the necessary angle of attack to the oncoming water flow. A similar construction is taught by U.S. Pat. No. 4,539,926, which again discloses a board-like floating body or planing board having a conventional centerboard or fixed keel or daggerboard, and a pivotal rudder for steering. Each of these sailboards is thus designed for oblique sailing.

U.S. Pat. No. 4,441,446 also discloses a sailboard, or windsurfing board, which utilizes a stationary centerboard or keel. However, instead of also using a pivotal rudder of the type disclosed by the two above-discussed patents, the board as disclosed in this particular patent uses a pair of rectangular fin plates, which project from opposite sides of the hull of the board, and which are adjustable vertically by a foot pedal to position them under the surface of the water to improve planing properties in a heavy wind, or above the water level during a light wind.

U.S. Pat. No. 4,331,093 discloses a hybrid wind surfboard or sailboard comprising two or more conventional surfboards which are linked or assembled together in tandem fashion. Each board has a conventional, fixed daggerboard keel located midship, and a stationary stabilizing fin at the stern of the board.

A feature common to all of the sailing devices disclosed in the above-noted U.S. patents is the fact that each sailboard or windsurfing board is of the type having a planing hull, which tends to skim the water surface, rather than displacing a substantial amount of water. This contrasts with conventional sailboats, which as a general rule are substantially heavier than sailboards and have hulls that are specifically shaped and designed to displace water, or to penetrate deeply down into the water, when sailing. Conventional sailboats are thus designed for oblique sailing, and for that reason require both pivotal rudders at their sterns, and centerboards or keels amidship.

Efforts have been made to improve the sailing speed of conventional sailboat hulls by using adjustable centerboards which are mounted to pivot above vertical axes. The centerboard disclosed in U.S. Pat. No. 3,580,203, for example, is free to pivot in the water against the resistance of a spring, while the centerboard shown in U.S. Pat. No. 4,345,535 is operatively connected to a mast which rotates the centerboard in response to any tilting of the mast. In each such case, however, the pivotal centerboard must be used in combination with the pivotal rudder to offset the tendency of the hull to make headway to leeward during sailing.

It will thus be apparent that while efforts have been made to stabilize sailing conditions for displacement-type hulls by utilizing adjustable centerboards, no such construction has been designed for planing-type hulls. Moreover, even when sailboat hulls have incorporated adjustable keels, it has always been in concert with, or in combination with, a pivotal rudder at the stern of the hull in order to effect the desired steering. Moreover, in most instances these prior devices have tended to be rather complicated in structure and in operation.

It is an object of this invention, therefore, to provide a novel, planing-type sailboard which utilized an adjustable keel, or centerboard or daggerboard, but without the use of a complimentary rudder for effecting the steering of the board.

A more specific object of this invention is to provide for a planing craft or sailboard, a single, pivotal keel mechanism which is relatively simple and inexpensive to manufacture, to install, and to use.

Still a further object of this invention is to provide an adjustably-keeled sailboard of the type described, which is adapted to be operated in the same manner as a conventional sailboard, and which has a pivotal, spring-loaded keel mechanism the position of which is automatically changed for each tack by virtue of the normal operator movements.

Other objects of the invention will be apparent hereinafter from the specification and from the recital of the appended claims, particularly when read in conjunction with the accompanying drawings.

SUMMARY OF THE INVENTION

A planing type sailboard is provided with a removable, automatically adjustable keel, which prevents crabbing of the board during use, and enables the operator to sail the hull in a direction substantially coincident with the longitudinal axis of the hull, and without employing a pivotal rudder or the like.

In each embodiment the upper end or head of the keel is supported in a recess in the bottom of the hull adjacent its stern, and for pivotal movement about a vertical axis for several degrees (e.g. from 4°-10°) to either side of a center position in which the keel lies in a substantially vertical plane through the longitudinal centerline of the hull. The pivotal movement of the keel is effected by normal operation of the board - i.e., by the strain or force exerted laterally on the hull by the legs of the operator standing on the hull.

In one embodiment the keel projects downwardly from a disk which is mounted for limited rotational movement in a recess in the bottom of the hull, and in a second embodiment it is removably mounted at its upper end in a generally pie-shaped keel box, which is pivotal about its rounded, nearly-pointed end between two limit positions. In either resilient spring means may be employed normally to maintain the keel in its centered position or in one of its limit positions; and adjustable screws may be employed to limit the movement of the keel in either direction.

THE DRAWINGS

Figure 2:
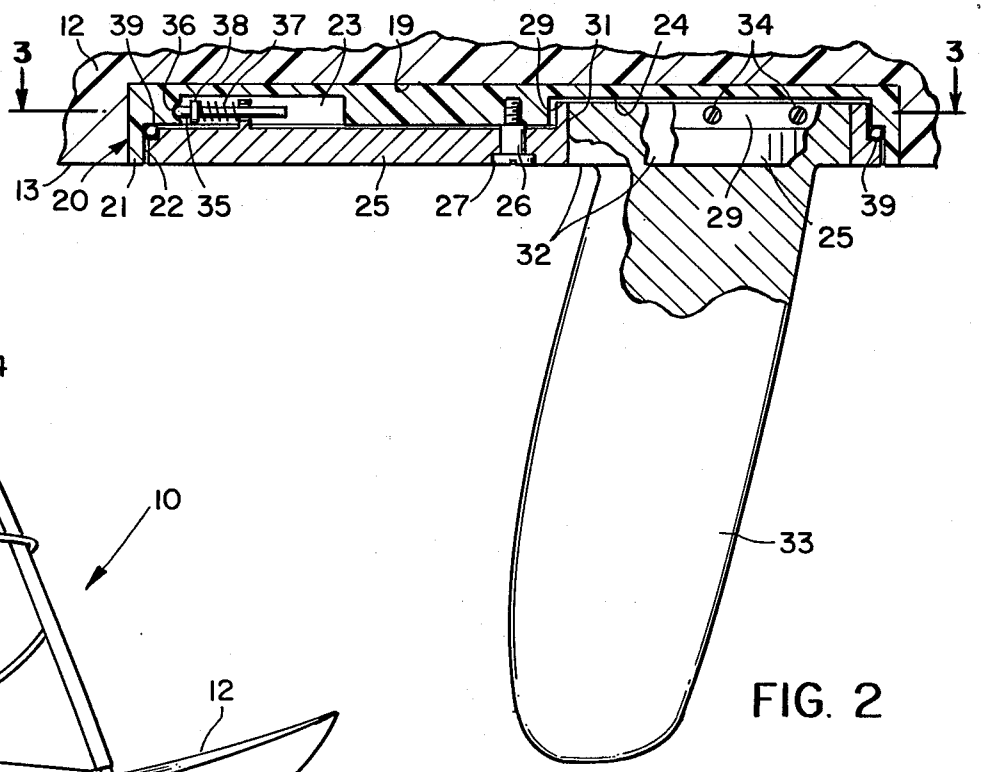
FIG. 2 is an enlarged, fragmentary sectional view taken generally along the line 2—2 in FIG. 1 looking in the direction of the arrows, showing the keel as it appears when aligned with the centerline of the hull, and showing portions of the keel in full.
Figure 4:
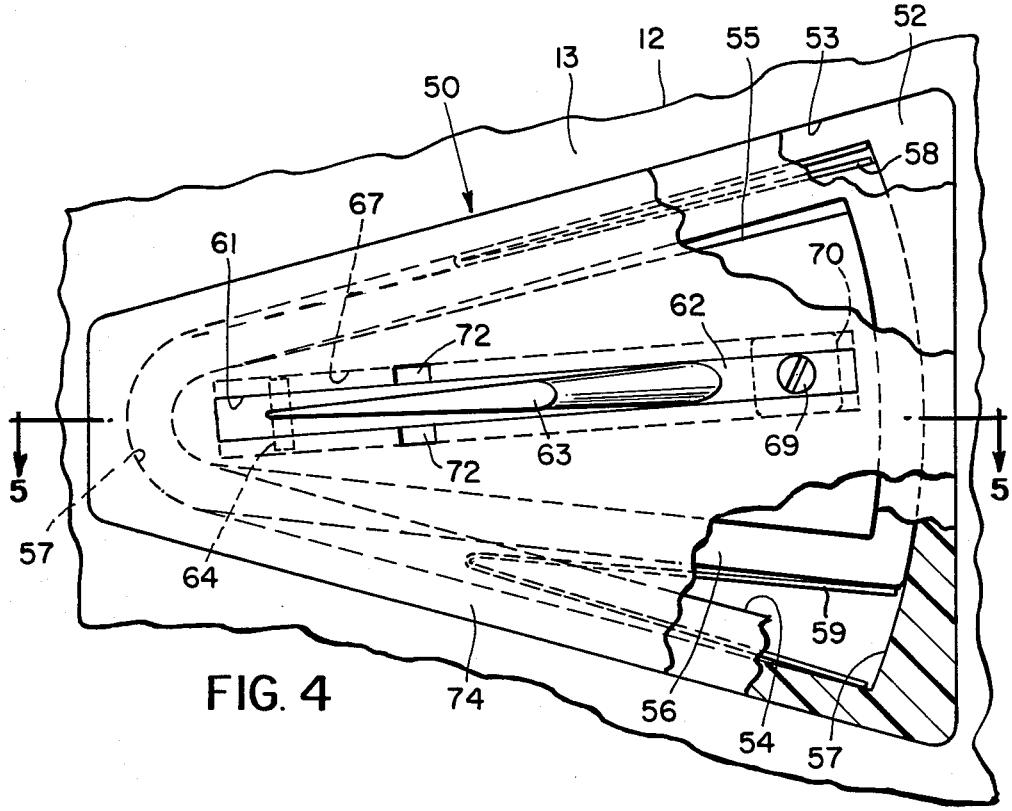
Figure 5:
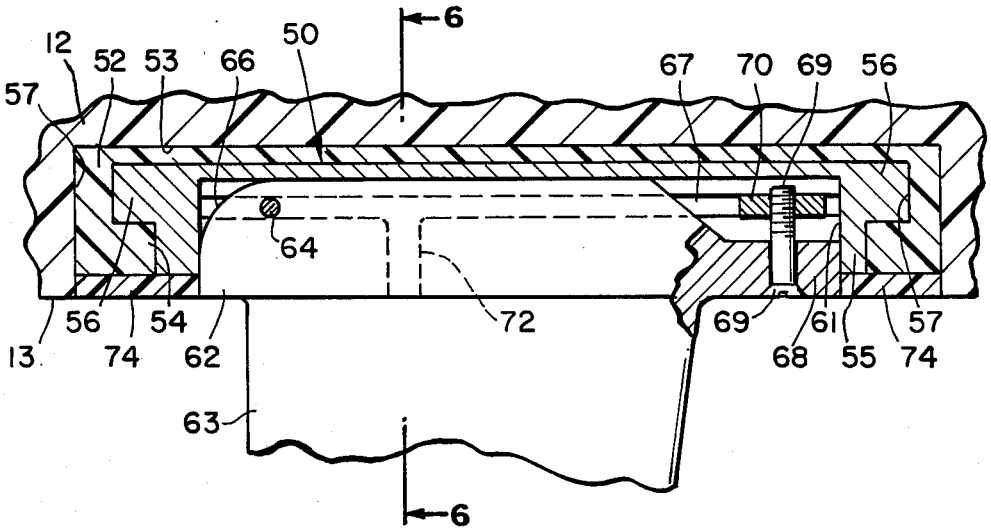

FIG. 3 is a fragmentary sectional view taken generally along the line 3—3 in FIG. 2 looking in the direction of the arrows, and again showing in full lines the position of the keel as it appears when aligned with the centerline of the hull, and in broken lines the position of the keel as it appears when pivoted to one of its two angular limit positions in which it is inclined to the hull centerline;

FIG. 4 is a fragmentary bottom plan view of a sailboard hull having a modified keel and mount therefor made according to a second embodiment of this invention;

FIG. 5 is a fragmentary sectional view taken generally along the line 5—5 in FIG. 4 looking in the direction of the arrows; and FIG. 6 is a sectional view taken generally along the line 6—6 in FIG. 5 looking in the direction of the arrows.

DETAILED DESCRIPTION OF THE PREFERRED EMBODIMENTS

Referring now to the drawings by numerals of reference, and first to FIGS. 1-3, 10 denotes generally a sailboard, comprising a hull 12 of fiberglass or the like, having a generally conventional configuration, and having a predominately flat undersurface 13 that is particularly suited for planing. Mounted in known manner on the hull 12 is a conventional windsurfing rig having a mast 14, a sail 16, and the usual frame member 18 adapted to be grasped by the operator. The exact sailing rig employed on the hull 12 forms no part of this invention, and therefore will not be described in greater detail herein.

Figure 1:
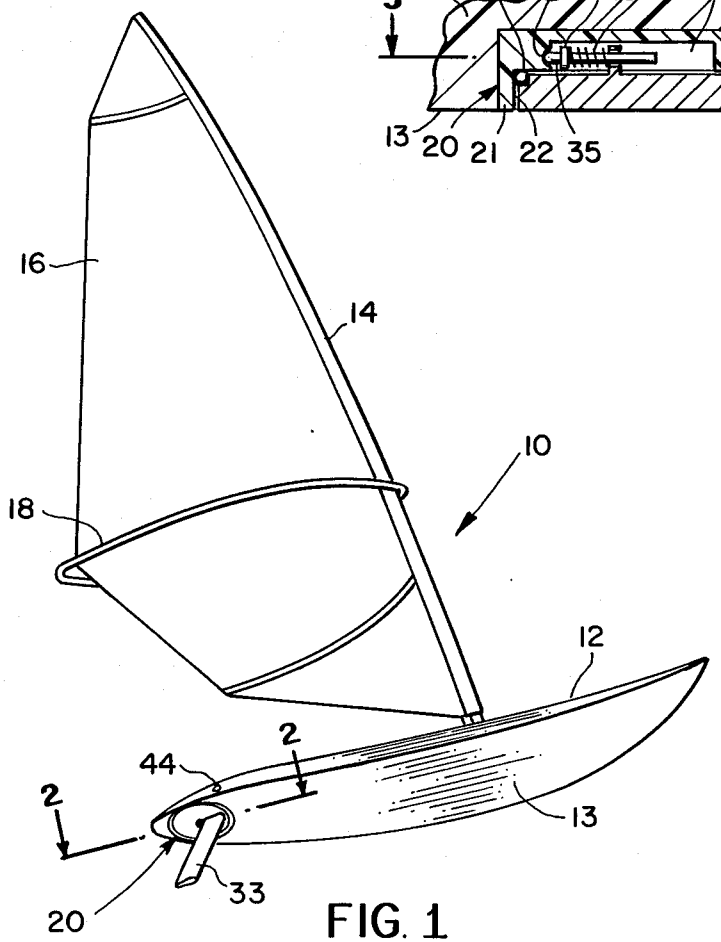
FIG. 1 is a perspective view of a sailboard having an adjustable keel and mount therefor made according to one embodiment of this invention, the sailboard being shown as it would appear when its hull is viewed from below and to one side thereof.

Mounted in a circular recess 19 that is formed in the underside of hull 12 adjacent the stern thereof is an adjustable keel mechanism, which may be made primarily of a corrosion resistant plastic or metal, and which is denoted generally in FIGS. 1-3 by the numeral 20. This mechanism comprises a circular mounting plate or support 21, which is secured in any conventional manner, such as by adhesive or the like, in the circular recess 19 so that the underside of plate 21 is disposed substantially coplanar with the underside 13 of the hull 12. Plate 21 has formed in its lower surface a large circular recess 22, which extends coaxially into plate 21 for substantially half the thickness thereof. The plane bottom surface of recess 22 has formed therein two additional recesses 23 and 24, which are substantially rectangular in configuration, and which are located at opposite sides respectively, of the centerline of plate 21. As shown more clearly in FIG. 3, recess 23 is nearly square, while recess 24 is rather oblong in configuration.

Mounted for limited coaxial rotation in recess 22 with its lower surface disposed substantially coplanar with the undersides of keel 12 and plate 21 is a circular, keel-holding disk 25. Disk 25 is held removably in recess 22 by a bolt 26, which has a shank that extends through a central opening in disk 25 and threads into plate 21 centrally thereof. Bolt 26 has an enlarged-diameter head 27, which seats in a cooperating recess formed centrally in the underside of disk 25, thereby to support the disk, as noted hereinafter, for limited oscillatory motion relative to plate 21.

At one side of its centerline disk 25 has projecting from its upper surface, and centrally into the recess 23 in plate 21, an integral, rectangularly shaped rib 28, which is disposed to support a spring-loaded detent as noted hereinafter. Adjacent the opposite side of its centerline disk 25 has formed thereon another, integral, upstanding, rectangularly shaped rib 29, which projects into the recess 24 in plate 21, and which extends substantially radially of the centerline of disk 25. As shown more clearly in FIG. 3, each of the ribs 28 and 29 is substantially narrower than the width of the respective recess 23 and 24, into which it projects, whereby the ribs are free, as noted hereinafter, to swing laterally within certain limits in the respective recesses 23 and 24, when the disk 25 is rotated relative to plate 21.

Mounted at its upper end in a rectangular opening 31, which extends through the disk 25 and centrally through its rectangular rib 29, is the rectangularly shaped head 32 of a conventional hydrofoil-shaped keel 33. Head 32 fits snugly in the opening 31, and as shown in FIG. 3 is secured against movement in this opening by a plurality of set screws 34 (three in the embodiment illustrated), which thread through openings in one side of the shoulder 29 on disk 25, and into engagement at their inner ends with one side of the keel head. Head 32 thus supports keel 33 for pivotal movement about the axis of bolt 26.

As noted above, disk 25 is mounted on bolt 26 for limited rotation relative to plate 21. To enhance this rotation a series of ball bearings 39 are mounted in a circumferential annular recess in the upper edge of disk 25 to be retained thereby against plate 21 at the bottom of recess 22. Normally, however, disk 25 is held resiliently in one or the other of its two limit positions of angular rotation relative to plate 21 by virtue of an over-center spring mechanism in the form of a spring-loaded detent or pin 35, (FIGS. 2 and 3), which is mounted adjacent one end thereof in an opening in the rib 28 for limited movement radially of the center of disk 25. Pin 35 has a rounded outer end 36 that normally is retained resiliently in a registering recess in plate 21 at one side of recess 23 (FIGS. 2 and 3) by a compression spring 37, which surrounds pin 35 between rib 28 and a circumferential shoulder 38 that is formed on pin 35 adjacent its outer end 36.

Spring 37 tends normally to cause disk 25 to be swung out of its centered position as shown by solid lines in FIGS. 2 and 3, and into one or the other of its limit positions in which the keel 33 is disposed in a plane inclined to the centerline of the hull 12, and the ribs 28 and 29 on disk 25 are, for example, in the positions as shown by broken lines in FIG. 3. As noted in greater detail hereinafter, the disk 25 is capable of being rotated either clockwise or counterclockwise about its axis relative to plate 21, and into one or the other of its limit positions. The extent to which disk 25 can be rotated in either direction is limited by the inner ends of a pair of adjustable limit screws 41 and 42 (FIG. 3), which are threaded nearly tangentially into plate 20 to project their inner ends into opposite sides of the recess 24 in spaced, confronting relation to the rib 29 adjacent its outer or right end as shown in FIG. 3. The kerfed, outer ends of screws 41 and 42 project into counterbores 43 and 44, respectively, which are formed in the hull 12 at opposite sides thereof to permit access to the screws 41 and 42 in the event that adjustment thereof is desired. In use, the operator stands on the hull 12, and while grasping the sailing rig, pulls against the forces generated against the sail by the wind. Depending upon the point of sail chosen, and the efficiency of the sailing rig, these forces will, at least to some extent, be downwind (to leeward), and to some extent across the wind. These forces are transmitted to the hull 12 by the operator's legs, and the connection between the sailing rig and hull. The center C of the keel 33 is located forwardly (to the right in FIG. 2) of the axis of rotation of disk 25 (centerline of bolt 26), so that the force of oncoming water can cause the keel 33 to be swung toward one of its limit positions. The hull and the keel 33 will thus be pushed, initially, through the water to leeward and forward, with the attitude of the hull being controlled by virtue of the pushing on the hull by the legs of the operator, and at the same time by the pulling force exerted on the sailing rig.

By pushing on the hull 12 the operator forces the keel 33 to rotate to a position to windward of the center, or in other words causes the disk 25 to be rotated, for example from its extreme clockwise position (not illustrated) to its extreme counterclockwise position in which its ribs 28 and 29 are shown in broken lines in FIG. 3. At this time the inner end of the limit screw 41 prevents any further counterclockwise rotation of disk 25, and the spring-loaded over-center detent 35 has become somewhat inclined to the rib 28, but nevertheless has maintained its outer end 36 seated in the corresponding recess in plate 21. For this reason the spring 37 will tend resiliently to retain the disk 25 in this limit position whenever the force exerted by the operator on the hull is removed. When the keel 33 has thus been swung to the windward position by the force of the oncoming water, the hull can be manipulated by the operator to travel in the direction of greatest efficiency, or in other words in a direction substantially parallel to the longitudinal centerline of the hull. The angled position of the hull relative to the keel allows acceleration of the hull exactly along its longitudinal axis, which is a feature not possible with crafts that are designed for oblique sailing. Undesirable crabbing of the sailboard is thus substantially eliminated.

Steering of the sailboard 10 is accomplished by fore and aft weight shifts made by the operator, and by so-called "foot steering" as in connection with conventional high speed sailboards. Slight longitudinal curve in the lower surface of the hull, which is conventional, allows side to side tilting of the hull 12 by the feet of the operator thereby to change direction even when the sailboard is moving at high speeds.

Referring now to FIGS. 4–6, wherein like numerals are employed to denote elements similar to those employed in the first embodiment, 50 denotes generally a modified keel mechanism comprising a trapizoidally shaped housing 52, which is secured, for example, by an adhesive or the like, in a correspondingly shaped recess 53, which is formed in hull 12 adjacent the stern thereof. Mounted for limited pivotal movement in a generally pie-shaped or sector-shaped recess 54 in the bottom of housing 52 is a similarly shaped but slightly smaller plate or keel box 55. Adjacent its upper end (FIG. 5) box 55 is surrounded by a peripheral flange 56, which is also generally pie-shaped in configuration, and which seats slidably in a correspondingly shaped recess 57 formed in housing 52 intermediate its ends. Flange 56 thus supports box 55 for limited angular movement in recess 54 about its nearly pointed, rounded end (its left end in FIG. 4), and against the resistance of a pair of leaf springs 58 and 59 (FIG. 5), which are mounted in recess 57 to engage opposite sides, respectively, of flange 56 adjacent the end thereof remoted from the pointed end of box 55.

Removably mounted in an elongate, rectangular recess 61, which is formed in the bottom of box 55 centrally thereof, is the upper, generally rectangularly shaped end or head 62 of a conventionally shaped keel 63. The keel head 62 is pivotally mounted adjacent one end thereof in slot 61 by a pin 64, which is secured intermediate its ends in the head 62 adjacent its upper, left-hand, rounded corner 66 as shown in FIG. 5. At opposite ends thereof pin 64 projects slidably into a pair of opposed, longitudinally extending grooves or recesses 67, which are formed in the opposed side walls of slot 61 in box 65 adjacent its upper end as shown in FIGS. 5 and 6. Adjacent its end remote from pin 64 the keel head 62 has formed thereon a generally tongue-shaped projection 68, which is secured by a screw 69 to a locking plate 70, which is supported at opposite sides thereof in the grooves 67 adjacent the ends thereof remote from pin 64.

The screw 69 removably supports the keel head 62 in a closed position in the keel box, and in such manner that the head fits snugly in the recess 61 in box 55. To remove the keel 63 the screw 69 is first removed, thus permitting the keel head 62 to be swung downwardly or clockwise (FIG. 5) about the axis of pin 64. Pin 64 is then slid toward the right in FIG. 5 in the grooves 67 until opposite ends thereof register with a pair of intersecting, vertically disposed slots or grooves 72, which are formed in the opposed sidewalls of the keel box recess 61. This enables opposite ends of the pin 64 then to be slid downwardly through the grooves 72, thereby permitting complete withdrawal of the keel head 62 from the box 55. This removable mounting means for the keel 63 is somewhat similar to that disclosed in U.S. Pat. No. 3,564,632, and permits ready removal and insertion of the keel into or out of the keel box 55.

When keel 63 is fully mounted in box 55 as shown in FIGS. 4 to 6, the undersides of the housing 52 and the box 55, which lie in a plane spaced slightly inwardly from the bottom surface of the hull 13, are disposed to be covered by a layer 74 of resilient sealing material, which can be adhered by adhesive or the like, over the lower surfaces of the box and the housing, thus keeping water and other debris from entering the keel mechanism during use.

In use, the keel 63 is disposed to pivot against the resistance of springs 58 and 59 about a vertical axis extending through the nearly pointed, rounded end (the left end in FIGS. 4 and 5) of the keel box 55. As in the first embodiment, the center of keel 63 is located forwardly of this vertical axis, but unlike the first embodiment, the springs 58 and 59 tend normally to maintain box 55 in a center position (not illustrated). In FIG. 4 box 55 is illustrated in one of its limit positions - i.e., when it has been pivoted counterclockwise about its left end to the point where its flange 56 has become nearly fully seated in the upper end of the recess 57 in housing 52 as viewed in this FIG. At this time it will be noted that spring 58 is compressed, and the lower edge of the flange 56 is spaced from the lower edge of the recess 57, and spring 59 is in its expanded mode. The overall pivotal movement of the keel box 55, simply for purposes of illustration, can be in the range of 8° to 10°, thus permitting the keel to be swung anywhere from 4° to 5° to either side of its normal, centered position. As in the case of the first embodiment, the swinging movement of the keel 63 will be controlled by the manner in which the operator manipulates the hull during use of the sailboard.

Although they are not illustrated in this second embodiment, it will be apparent that, if desired, adjusting screws can be threaded into opposite sides of the recess 54 adjacent the right end of the box 55, as shown in FIG. 4, if it is desired to utilize some adjustable means for limiting the pivotal movement of box 55. Also, of course, keel 33 could be designed, if desired, to be mounted in disk 25 by a pivot pin 64 and bolt 69 of the type employed in the second embodiment.

From the foregoing it will be apparent that the present invention provides a relatively simple and inexpensive means for considerably increasing the efficiency of a sailboard of the type described. By using a keel which is pivotal automatically about a substantially vertical axis located rearwardly of the keel's center, it is possible to enable the sailboard to be directed or sailed in a direction coincident with the longitudinal axis of its hull, rather than, as in the past, having to sail the hull at an oblique angle to the desired direction. And the keel can be designed selectively to be retained resiliently or normally either in a centered position, or by a resilient, over-center mechanism, in one or the other of its limit positions. Moreover, in view of the nature of the keel mechanisms disclosed herein, they can be produced in kit form for insertion into existing sailboards, thereby permitting the conversion of such boards with relative ease.

Moreover, while this invention has been illustrated and described in detail in connection with only certain embodiments thereof, it would be apparent that it is capable of still further modification, and that this application is intended to cover any such modifications as may fall within the scope of one skilled in the art or the appended claims.

I claim:

1. A rudderless sailing craft, comprising a planing hull having thereon a sailing rig disposed to be grasped and manipulated by an operator standing on the hull, a single hydrofoil-shaped keel projecting from the underside of said hull adjacent the stern thereof, and operative to assist in the steering of said hull, and means mounting the upper end of said keel on said hull for limited pivotal movement from one position to another in response to oncoming water, and in opposite directions about a substantially vertical axis relative to a centered position in which said keel is disposed in a plane substantially coincident with the longitudinal axis of said hull, said vertical axis being located rearwardly of the center of said keel, whereby said keel will be forced by the flow of oncoming water to rotate in the windward direction from its centered position.

2. A rudderless sailing craft as defined in claim 1, wherein said keel is the only projection on the underside of said hull for use in the steering of said hull.

3. A rudderless sailing craft as defined in claim 1, wherein said mounting means includes means resiliently resisting pivotal movement of said keel about said vertical axis.

4. A rudderless sailing craft as defined in claim 1, wherein said mounting means includes adjustable limit means for adjusting the degree to which said keel can be pivoted in either direction away from its centered position.

5. A rudderless sailing craft as defined in claim 1, wherein said mounting means comprises a support member mounted in a first recess in the underside of said keel adjacent the stern thereof for limited angular movement about said axis, and means releasably securing said upper end of said keel in a second, elongate recess formed in the underside of said member to be positioned forwardly of said vertical axis and centrally of the longitudinal centerline of said hull, when said keel is in its centered position.

6. A rudderless sailing craft as defined in claim 5, wherein said means releasably securing said upper end of said keel comprises a pin pivotally connecting said upper end of said keel to said support member for swinging movement about a second axis extending transverse to said vertical axis, and between a first position in which said upper end of said keel is fully seated in said second recess, and a second position in which said upper end of said keel is inclined downwardly from the underside of said keel, means spaced from said pin for releasably securing said upper end of said keel in said first position, and means supporting said pin for sliding movement selectively into and out of engagement with said support member when said upper end of said keel is in its second position.

7. A rudderless sailing craft as defined in claim 1, wherein said mounting means comprises a disc rotatably mounted in a circular recess in the underside of said hull adjacent its stern for oscillatory movement about said vertical axis, and means releasably securing said keel at its upper end in said disc for rotation therewith into and out of said centered position when said craft is under sail.

8. A rudderless sailing craft as defined in claim 7, wherein said keel is secured at its upper end in said disc forwardly of said axis, whereby said keel is automatically pivoted to the windward direction by the flow of oncoming water, when said craft is under sail.

9. A rudderless sailing craft as defined in claim 1, wherein said mounting means comprises a sector-shaped keel box, means supporting said keel box in a similarly shaped recess formed in the underside of said hull adjacent the stern thereof for limited pivotal movement about said axis, and means releasably securing said keel at its upper end in said keel box for pivotal movement therewith into and out of its centered position, when said craft is under sail, said sector-shaped keel box having a nearly pointed end centered on and pivotal about said vertical axis.

10. An adjustable keel mechanism for planing hulls and the like, comprising a housing having a generally plane underside, and disposed to be secured in a recess in the bottom of a planing hull adjacent the stern thereof so that said underside of said housing is at least nearly coplanar with the bottom of said hull, a keel supporting member mounted in a recess in said underside of said housing for limited rotational movement in opposite directions between first and second limit positions, and about a first axis extending normal to said underside of said housing, and having a plane bottom surface disposed in substantial coplanar relation with the underside of said housing, a hydrofoil-shaped keel having an elongate, generally rectangularly-shaped head on its upper end, and means releasably securing said head of said keel in an elongate recess formed in said bottom surface of said supporting member, thereby to support the keel in a plane which contains said first axis, and which extends substantially normal to said bottom surface of the supporting member, said elongate recess in said supporting member extending radially of said first axis operatively to position the center of said keel in laterally offset relation to said first axis.

11. An adjustable keel mechanism as defined in claim 10, including resilient means interposed between said housing and said keel supporting member and operative resiliently to retain said supporting member medially of the two limit positions of its rotational movement relative to said housing.

12. An adjustable keel mechanism as defined in claim 10, including resilient means interposed between said housing and said keel supporting member and operative normally to retain said keel supporting member in one or the other of its limit positions.

13. An adjustable keel mechanism as defined in claim 10, wherein said means releasably securing said head in said supporting member comprises means pivotally connecting said head adjacent one end thereof to said support member for swinging movement about a second axis extending normal to said first axis, and into and out of an operative position in which said head is fully seated in said elongate recess in said supporting member, and means adjacent the opposite end of said head for releasably securing said head in its operative position, and operable to release said opposite end of said head and to permit swinging movement thereof about said second axis downwardly toward an inoperative position, said means pivotally connecting said head to said support member being operable completely to disconnect said head from said support member when said head as been swung to its inoperatived position.

14. An adjustable keel mechanism as defined in claim 10, wherein said support member is disk-shaped in configuration and is mounted for limited rotational movement in a circular recess in said underside of said housing.

15. An adjustable keel mechanism as defined in claim 10, wherein said support member is in the shape of a sector and is mounted for pivotal movement about one end thereof in a similarly shaped recess in said underside of said housing.

16. An adjustable keel mechanism as defined in claim 10, wherein a resilient member seals any gaps between said housing and said keel supporting member from the surrounding water.

* * * * *